US005483784A

United States Patent [19]

Owensby et al.

[11] Patent Number: 5,483,784

[45] Date of Patent: Jan. 16, 1996

[54] METHOD AND APPARATUS FOR LOADING BAGS

[75] Inventors: Joseph E. Owensby, Spartanburg; Howard D. Conner, Mauldin; Frederick A. Dobbins, Lyman, all of S.C.

[73] Assignee: W. R. Grace & Co.-Conn., Duncan, S.C.

[21] Appl. No.: 114,791

[22] Filed: Aug. 31, 1993

[51] Int. Cl.[6] ..... B65B 43/26; B65B 1/04; B65B 5/00; B65B 43/42

[52] U.S. Cl. ..... 53/459; 53/469; 53/477; 53/570; 53/576; 53/567

[58] Field of Search ..... 53/258, 253, 250, 53/477, 469, 459, 576, 570, 567, 442; 452/32, 34, 35, 39; 426/105, 129, 410, 413, 414, 646, 645

[56] References Cited

U.S. PATENT DOCUMENTS

| | | | |
|---|---|---|---|
| 3,288,153 | 11/1966 | Ballard et al. | 53/253 |
| 3,454,980 | 7/1969 | Washburn | 17/35 |
| 3,553,768 | 1/1971 | Wilmsen | 17/35 |
| 3,555,775 | 1/1971 | McMillan | 53/576 |
| 3,765,090 | 10/1973 | Roberts et al. | 426/38 |
| 3,996,721 | 12/1976 | Mercer | 53/567 |
| 4,202,153 | 5/1980 | Lerner et al. | 53/258 |
| 4,308,710 | 1/1982 | Sandberg | 53/469 |
| 4,335,488 | 6/1982 | Becker | 17/42 |
| 4,510,733 | 4/1985 | Hansen et al. | 53/570 |
| 4,558,488 | 12/1985 | Martinek | 17/41 |
| 4,672,793 | 6/1987 | Terlizzi, Jr. et al. | 53/434 |
| 4,812,320 | 3/1989 | Ruzek | 426/129 |
| 4,818,548 | 4/1989 | Cheng | 426/129 |
| 4,869,049 | 9/1989 | Richards et al. | 53/567 |
| 5,044,142 | 9/1991 | Gianelli | 53/442 |
| 5,193,290 | 3/1993 | Tolson | 53/442 |

*Primary Examiner*—John Sipos
*Assistant Examiner*—Rodney Butler
*Attorney, Agent, or Firm*—Thomas C. Lagaly; Mark B. Quatt; William D. Lee

[57] ABSTRACT

An apparatus for, and a method of, loading a meat product into a thermoplastic bag or casing is disclosed. Particularly, the present invention discloses an apparatus for, and method of, loading a meat product into a thermoplastic bag or casing such that the area used to produce a heat seal closure of the bag or casing is protected against contamination during the product loading process.

19 Claims, 4 Drawing Sheets

METHOD AND APPARATUS FOR LOADING BAGS

BACKGROUND OF THE INVENTION

1. Field of the Invention

The present invention relates generally to a method and apparatus for meat stuffing for cook-in use and for loading of products which contaminate the bag such as, for example, cooked roast beef with spices, juices, and the like on the surface, and corned beef with peppers and the like on the surface. More particularly, this invention relates to an apparatus and a method of loading meat product in a thermoplastic bag or casing which will be heat sealed and which protects the heat seal area from contamination by the product during the loading operation.

2. Description of the Related Art

Many foods during preprocessing are stuffed into a casing and then placed in a heated medium, such as a hot water bath, for cook-in to produce a precooked, encased food product. Generally, a portion of a moldable raw meat, such as sectioned ham, multiple piece whole muscle meat, or meat emulsion, is pressed into a bag or casing lined stainless steel cooking mold, then cooked while in the mold, and thereafter packaged as a pre-cooked compacted meat product. Alternatively, the moldable raw meat, multiple piece whole muscle meat, or emulsion can be pressed into the casing contained within a mold and then removed from the mold before cooking. The term "cook-in" conventionally refers to cooking of a food product while contained in a package. Alternatively, the package may be a heat shrinkable bag which shrinks tightly about a contained food product upon initial exposure to cook-in conditions. Further, a heat shrinkable bag may be preshrunk before cooking of the loaded product to minimize excess bag material. Further, the product may be loaded or stuffed into a casing or bag and cooked without the use of a separate mold.

The term "cook-in package" is intended to refer to packaging material structurally capable of withstanding exposure to cook-in time-temperature conditions while containing a food product. Cook-in time-temperature conditions typically imply a long slow cook, for example by submersion in water at 70°–80° C. for 4–6 hours. Under such conditions, a packaging material properly characterized as cook-in will maintain heat seal integrity and will be delamination resistant. The packaging material typically will also be heat shrinkable under these conditions so as to form a neatly fitting package and preferably should have a tendency toward product adhesion to minimize "cook-out" or collection of fluids between the surface of the food product and the interior surface of the bag.

It is desirable that a cook-in package closely conform to the contained food product to prevent "cook-out", i.e., exudation of fluids from the food product during cooking. By restricting exudation of fluids from a cook-in contained food product, the yield of the precooked food product is increased, since fluid retention tends to increase product weight. It is also desirable that the cook-in thermoplastic bag or casing not have its heat seal area contaminated so as to prevent heat seal failure.

It is also desirable to provide a contamination free sealing area on a bag which is used for packaging meat products which are already cooked and which have spices, juices and the like on their surfaces. These types of meat products can be especially troublesome to load without contaminating the heat sealing area of a bag leading to a high seal failure rate.

U.S. Pat. No. 3,765,090 (Roberts et. al.) discloses a method of making cheese including loading the curd into a casing using a tube to help compress the curd and direct the partially compressed curd into the container. Containers contemplated include those of cardboard and of metal as well as plastic bags. There is no cook-in of the cheese product.

U.S. Pat. No. 4,672,793 (Terlizzi, Jr. et. al.) discloses an improved method of vacuum packaging a molded meat product in a cook-in bag lining a cooking mold. The teaching is directed to an improved vacuum system for use during packing of the meat product. This patent does not appreciate the means of protecting the heat sealing area of the bag of the present invention.

U.S. Pat. No. 4,335,488 (Becker) discloses a device for filling a shirred tubular casing having a fixed casing diameter sizing means which is not a mold. U.S. Pat. Nos. 4,558,488 (Martinek), 3,553,768 (Wilmsen), 3,454,980 (Washburn) disclose various methods and apparatus for producing uniform sized meat stuffed casings. None of these patents utilized a mold to hold the bag or casing while simultaneously protecting a heat sealing area from contamination and heat seal failure.

OBJECTS AND SUMMARY OF THE INVENTION

One object of the present invention is to provide an apparatus for stuffing of cased meat products while protecting the heat sealing area of the casing from contamination and heat seal failure.

Another object of the present invention is to provide a method of stuffing multiple pieces of whole muscle meat into a thermoplastic bag or casing while maintaining a clean heat sealing area of said bag or casing.

Yet another object of the present invention is to provide an apparatus and method for stuffing a thermoplastic bag or casing with multiple pieces of whole muscle meat automatically without the need to hand load the meat into the bag or casing.

A further object is to provide an improved method of producing cased multiple piece whole muscle meat products using a heat sealed casing.

A still further object of the present invention is to provide for the use of heat sealing of casing materials which heretofore did not achieve the required seal integrity.

Accordingly, one form of the present invention relates to a method of loading a meat product into a bag, including the steps of: loading a bag, having a closed end and an open end, into a horn, having a closed end and an open end, such that the open end of the bag protrudes out of the open end of the horn; pulling the open end of the bag over the open end of the horn, thereby starting to invert the bag over the outside of the horn; continuing to invert the bag over the outside of the horn until the whole bag is inverted and the closed end of the bag covers the open end of the horn; introducing the open end of a product loading chute, containing a product to be loaded into the bag which has been inverted over the horn, a short distance into the open end of the horn, thereby starting to force the bag back into the inside of the horn; introducing the product into the bag using a product discharge means and forcing substantially all of the bag back into the interior of the horn, leaving an amount of the bag adjacent to the bag opening sufficient to allow heat sealing, inverted over the outside of the horn; and discharging the now product loaded bag from the horn; thereby producing a product loaded bag having a contamination free area of the bag adjacent to the bag opening sufficient for forming a heat seal by a heat sealing means.

Another form of the present invention relates to a method of loading a meat product, including the steps of: loading a bag, having a closed end and an open end, into a horn having a closed end, an open end, and an opening in the side of said horn, such that the open end of the bag protrudes out of the open end of the horn; pulling the open end of the bag over the open end of the horn, thereby starting to invert the bag over the outside of the horn: continuing to invert the bag over the outside of the horn until the whole bag is inverted and the closed end of the bag covers the open end of the horn; introducing the open end of a product loading chute, containing a product to be loaded into the bag which has been inverted over the horn, a short distance into the open end of the horn, thereby starting to force the bag back into the inside of the horn; introducing the product into the bag using a product discharge means and forcing substantially all of the bag back into the interior of the horn, leaving an amount of the bag adjacent to the bag opening sufficient to allow heat sealing, inverted over the outside of the horn; and discharging the now product loaded bag from the horn; further characterized as allowing the bag to be loaded into and the bagged product to be removed from said horn by way of the opening in the side of said horn, thereby producing a product loaded bag having a contamination free area of the bag adjacent to the bag opening sufficient for forming a heat seal by a heat sealing means.

Yet another form of the present invention relates to an apparatus for loading a meat product into a bag comprising: a horn having a closed end and an open end, said open end adapted to accept a bag having an open end and a closed end, further adapted to allow said bag to be inverted over the outside of said horn; a product loading chute suitable for loading a product to be bagged and having a open end and a closed end adapted to accept a discharge means for moving the loaded product from the product loading chute into the bag positioned in the horn, said product loading chute positioned such that the open end of the product loading chute can be inserted a desired distance into the open end of said horn; and a discharge means located within said product loading chute to force the product out of the product loading chute and into the bag loaded in said horn.

Still another form of the invention relates to an apparatus wherein the horn has two open ends and wherein the second open end may be used to discharge the stuffed or loaded bag or casing.

Preferred forms of the invention, as well as other embodiments, objects, features and advantages of this invention, will be apparent from the following detailed description which is to be read in connection with the accompanying drawings.

DESCRIPTION OF THE PREFERRED EMBODIMENTS OF THE INVENTION

Figure 1A:
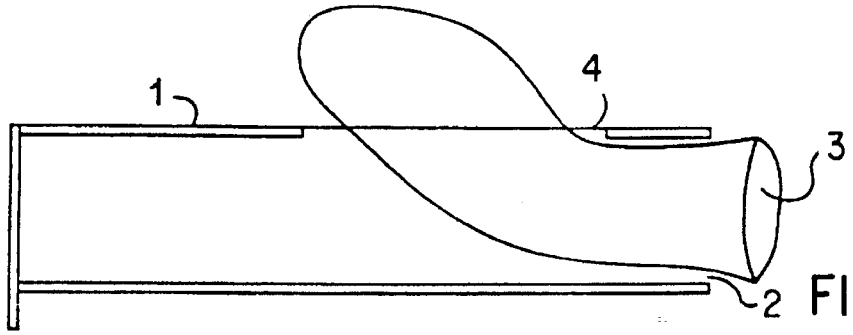
FIG. 1 shows a schematic sequence of one preferred method of the present invention.
Figure 1B:
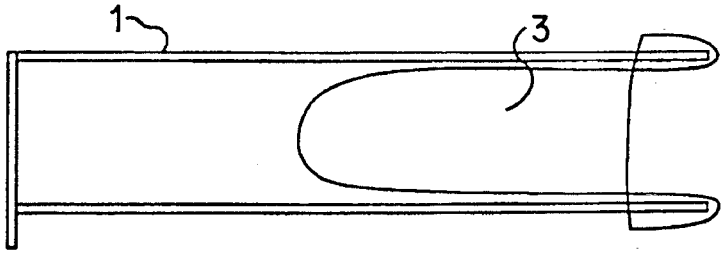
Figure 1C:
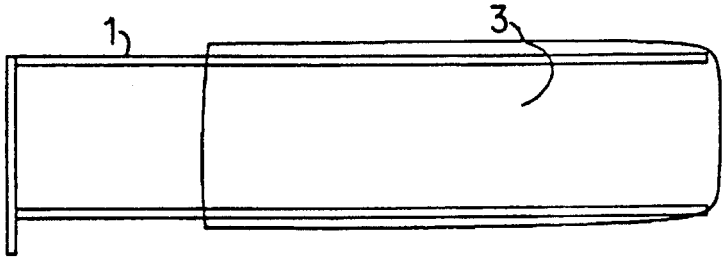
Figure 1D:
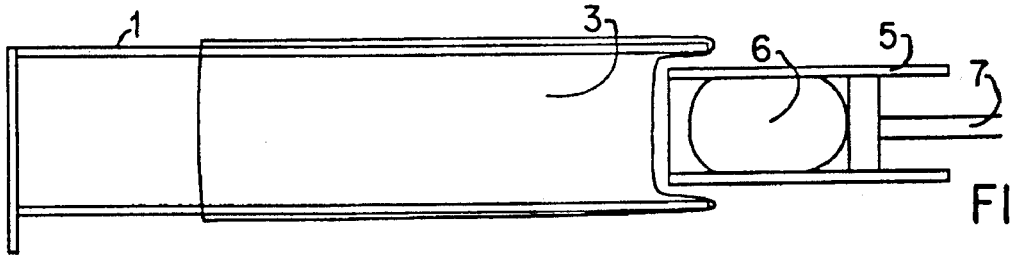
Figure 1E:
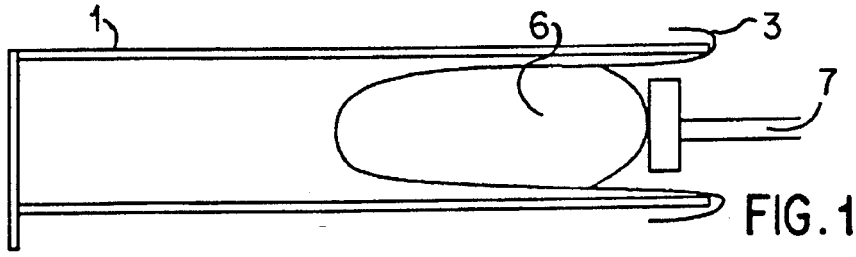
Figure 1F:
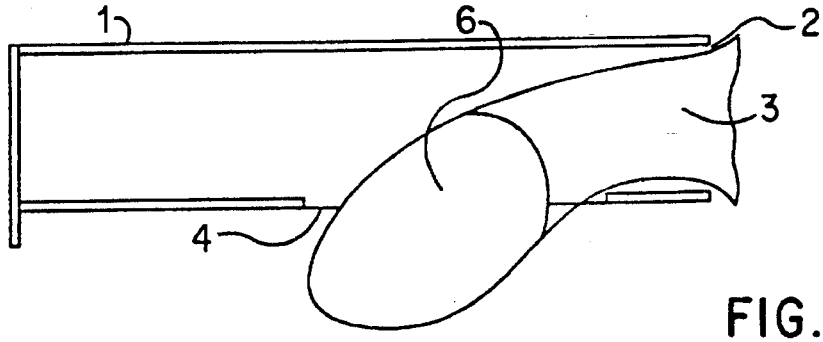

The present invention will be better understood from the specification taken in conjunction with the accompanying drawings in which like reference numerals refer to like parts.

In FIG. 1 there is shown a schematic sequence illustrating a preferred embodiment of the method of the present invention wherein in (A) a horn assembly 1 having an open end 2 and optional side opening 4 has a thermoplastic bag or casing 3, having one closed end and one open end, loaded therein; in (B) the bag or casing 3 has been fully loaded into horn assembly 1 and the open end has been inverted back over the outside of horn assembly 1; in (C) the bag or casing 3 has been completely inverted over the outside of horn assembly 1 such that the closed end of bag or casing 3 is covering the open end 2 of horn assembly 1; in (D) product loading chute 5 containing product 6 is inserted a short distance into the open end 2 of horn assembly 1 which starts forcing bag or casing 3 back into the interior of horn assembly 1, also shown is product discharge means 7 which forces product 6 out of the product loading chute 5 and into the bag or casing 3 while simultaneously forcing substantially all of bag or casing 3 back inside horn assembly 1; (E) shows product 6 completely loaded into bag or casing 3 by product discharge means 7 while a portion of bag or casing 3 adjacent to its open end is still inverted over the open end 2 of horn assembly 1 thereby protecting the heat sealing area from contamination; (F) shows the product 6 loaded bag or casing 3 being discharged from horn assembly 1 through optional side opening 4 after the product loading chute and discharge means have been removed from the horn to minimize contamination. It is to be appreciated that the horn assembly 1 may have two open ends and that product 6 loaded bag or casing 3 may be discharged out of horn assembly 1 through the second open end.

Figure 2:
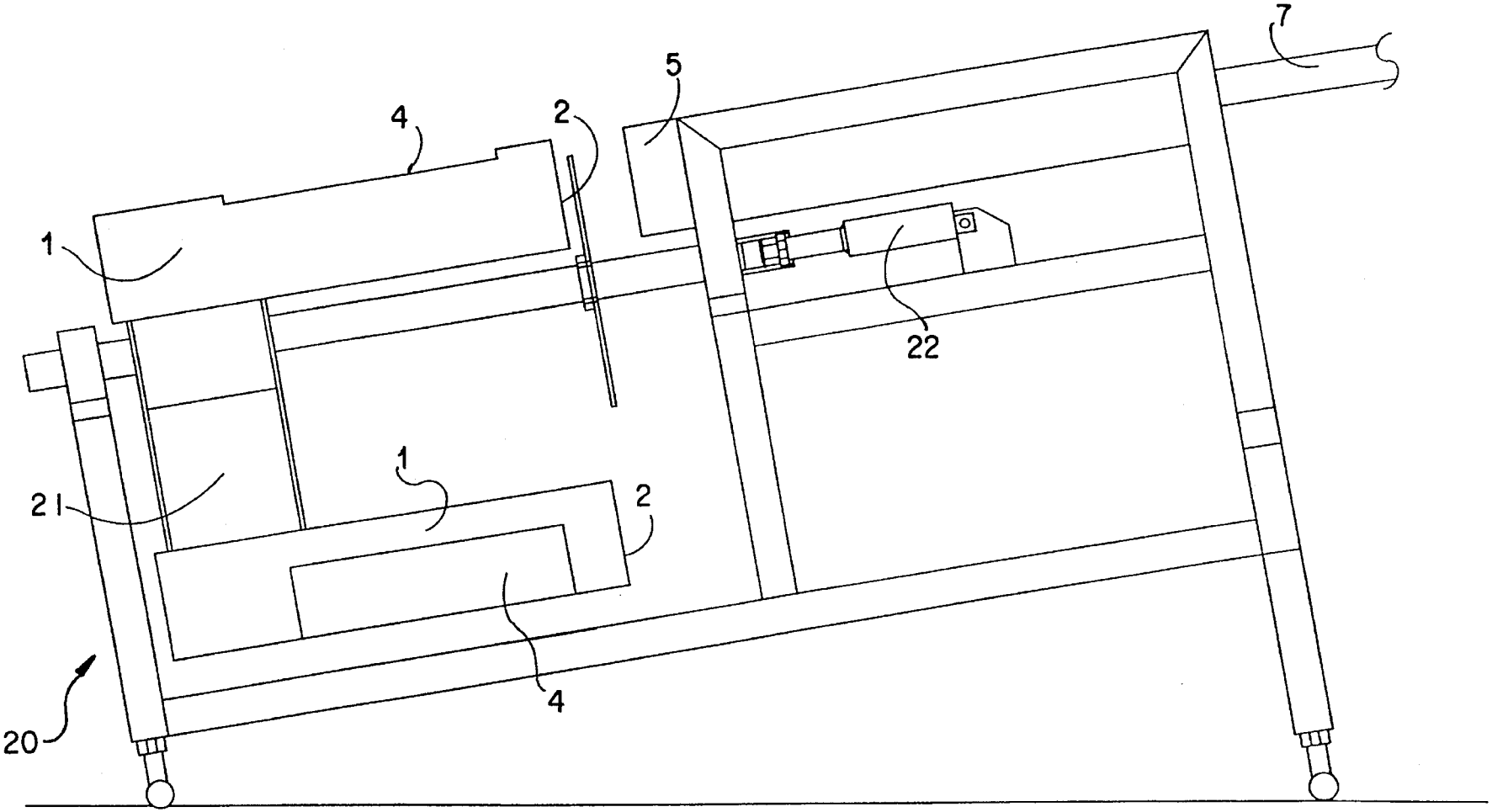
FIG. 2 shows a plan side view of a preferred embodiment of an apparatus of the present invention.

FIG. 2 shows a side plan view of one embodiment of an apparatus of the present invention generally as 20, having multiple horn assemblies 1, having open ends 2 and optional side openings 4, mounted on a turret assembly 21 which rotates about a center by rotating means (not shown). Apparatus 20 also has mounted thereon product loading chute 5 having product discharge means 7 located therein, product loading chute 5 being positioned such that each horn assembly 1 open end 2 is aligned with the open end of said product loading chute 5 at one position during the rotation of said horn assemblies 1 mounted on turret assembly 21. The entire turret assembly, including horn assemblies 1, is movable axially, and is pulled by cylinder 22 to cause the open end 2 of the horn assembly 1 to move relative to the open end of the product loading chute 5, effectively placing the open end of the horn assembly 1 over the open end of the product loading chute 5.

Figure 3:
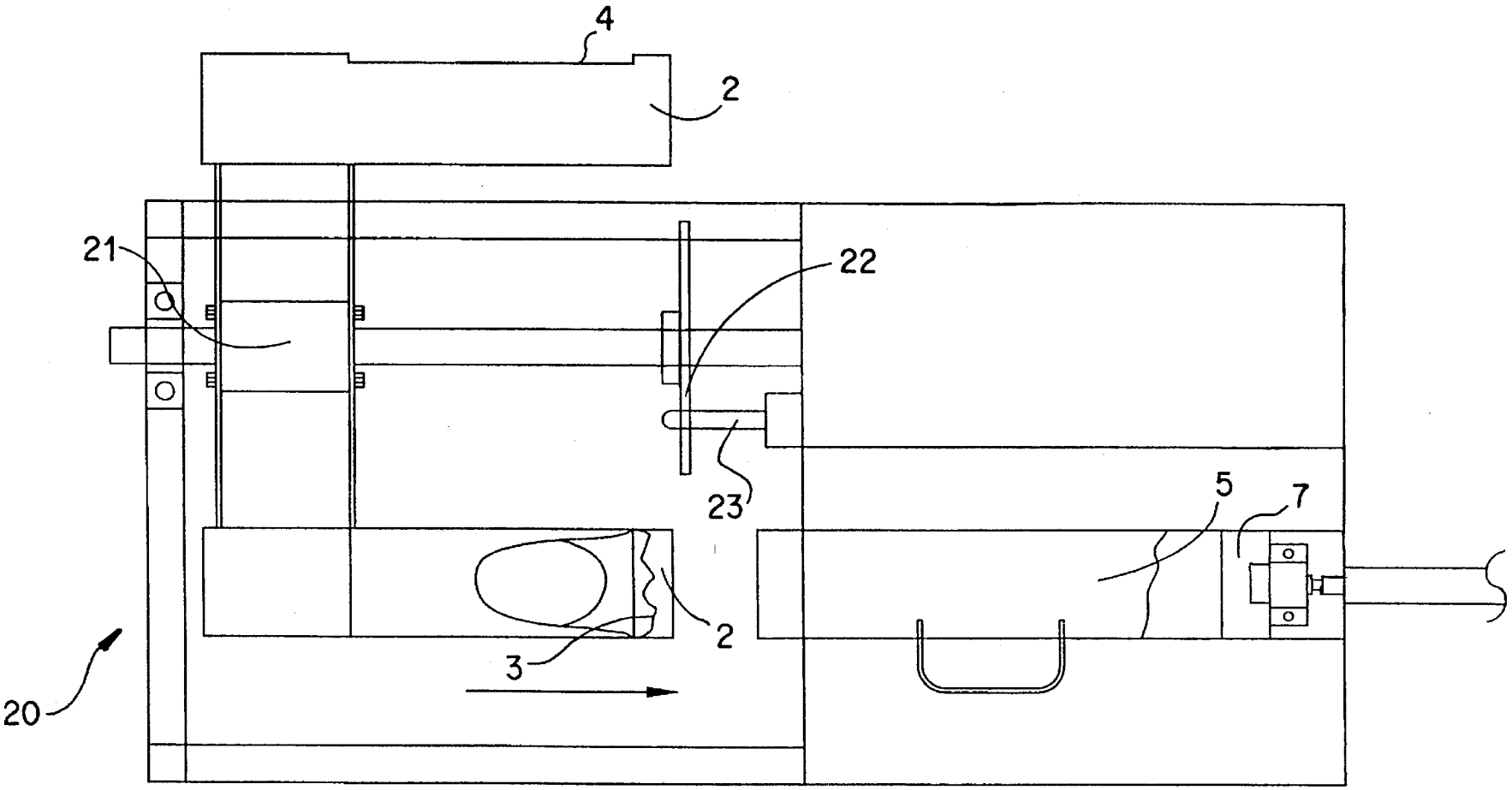
FIG. 3 shows a plan top view of the apparatus of FIG. 2.

In FIG. 3 is shown a top plan view of the apparatus 20 of FIG. 2 showing the open end of bag or casing 3 inverted outside of horn assembly 1 at opening 2 after loading of product 6 into said bag or casing 3. Also shown is locating plate 22 which has alignment slots which mate with alignment pin 25 to accurately align the horn assembly opening 2 with the opening of product loading chute 5. Alignment pin 25 retracts to allow the entire horn assembly to be rotated.

Figure 4:
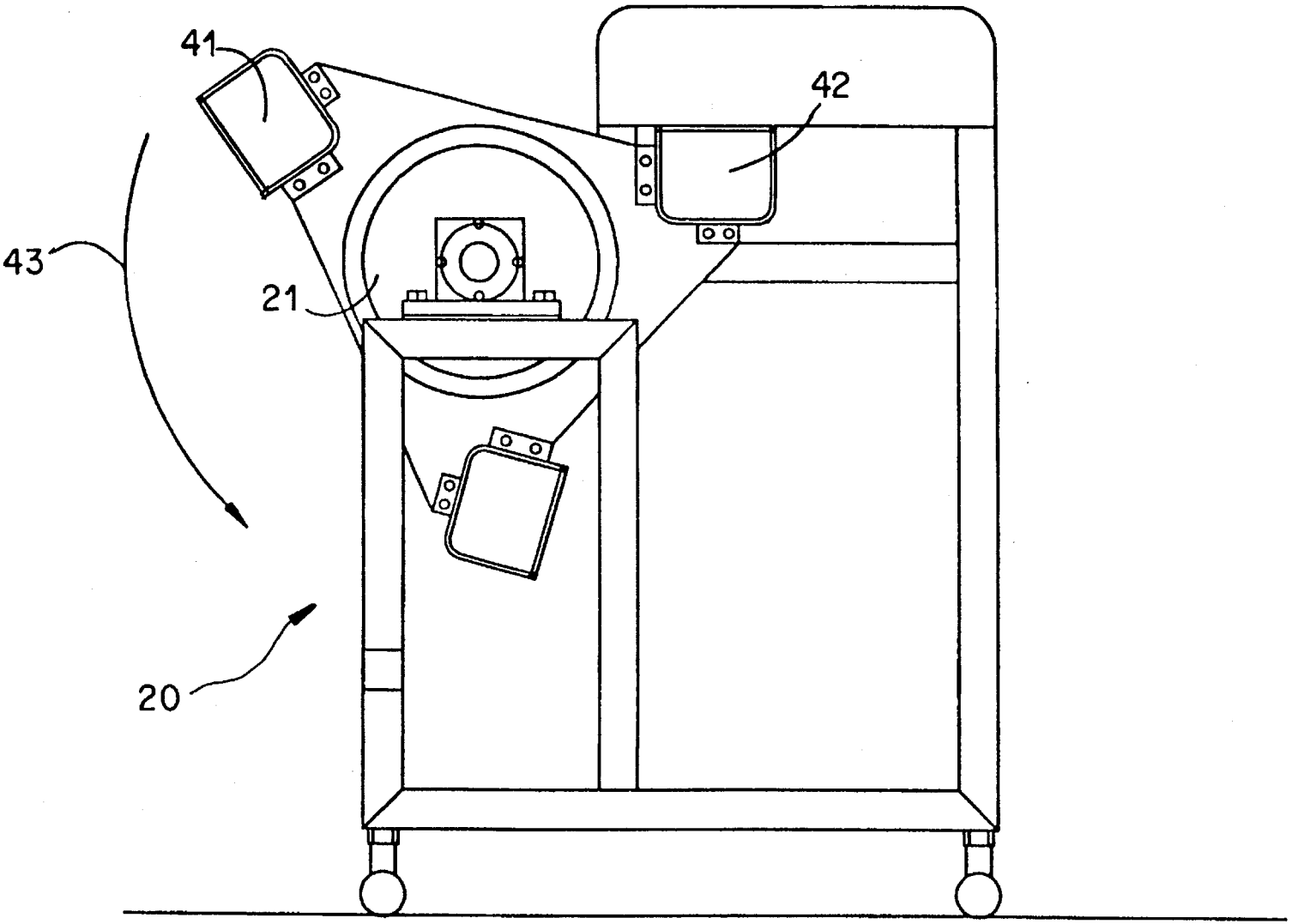
FIG. 4 shows a plan end view of an apparatus of FIG. 2.

FIG. 4 shows an end plan view of the apparatus 20 of FIG. 2 showing the horn assembly 1 on turret assembly 21 located at position 41 ready for loading of a bag or casing 3 (not shown). This figure also shows another horn assembly 1 mounted on turret assembly 21 located at position 42 and aligned with product loading chute 5 (not shown) ready for loading product 6 (not shown) into bag or casing 3 (not shown). Turret assembly 21 rotating in the direction of arrow 45. Also, contemplated is a turret assembly which rotates about an axis which is not horizontal.

It is to be appreciated that the mechanical, electrical and/or electronic devices and means necessary to produce the apparatus and implement the method of the present invention are well understood, and require no undue experimentation, by those skilled in the art. Thus, motors, drive systems, sequencing means and timing systems are well known and need no further comment here. Likewise, vacuumizing and/or heat sealing apparatus and methods are well known in the art and do not need to be further detailed herein.

Any of the well known meat bag or casing materials which are heat sealable may be used with the present invention. Thus, a packaging material structurally capable of withstanding exposure to cook-in time-temperature conditions while containing a food product and that is heat sealable is suitable. The use of shrinkable bag or casing material is especially well suited for use with the present invention. Suitable bag or casing materials include, for example, bags or casing made from thermoplastics, elastomers, thermoplastic elastomers, copolyesters, polyolefins, copolyesters copolyesters, polyurethanes, polysytrenes, polycarbonates, polyvinyl acetate, polyvinyl chloride, PVDC, polyamides, and polyalkaline carbonates. A particularly preferred packaging material is thermoplastic bi-axially oriented polyolefin film. The bags or casings may be loaded onto the horn by hand or mechanically by known means, such as for example, vacuum or pressurized fluid. The use of such bag and casing materials and forms is well understood by routineers in the art.

The horn assembly 1 and the product loading chute 5 may be made from any semi-rigid to rigid polymeric material which maintains its shape and dimensions under the temperature and pressure conditions encountered during the product loading process. Such conditions are well known and understood in the art. Suitable polymeric materials include, for example, polyolefins such as, polyvinyl chloride, polyethylene, polypropylene, copolymers thereof, as well as cast acrylic, and the like.

It is to be understood that stainless steel is the presently preferred material for use in the present invention, for the horn assembly 1 and product loading chute 5, as well as the rest of the apparatus of the present invention.

The horn assembly 1 may have only an open end 2 or it may in addition have a side opening 4, and/or it may have two open ends. This optional side opening 4 and/or second end opening is helpful for loading bags or casings into horn assembly 1 and for discharging product loaded bags or casings from horn assembly 1. This is especially true where the loading and unloading of the horn is done automatically by mechanical means.

Although the illustrative embodiments of the present invention have been described herein with reference to the accompanying drawings it is to be understood that the invention is not limited to those precise embodiments, and that various other changes and modifications may be effected therein by one skilled in the art without departing from the scope or spirit of the invention.

What is claimed is:

1. A method of loading a product, including the steps of:

a) loading a bag, having a closed end and an open end, into a horn having a closed end, an open end, and an opening in the side of said horn, such that the bag is loaded into the opening in the side of the horn and the open end of the bag protrudes out of the open end of the horn;

b) pulling the open end of the bag over the open end of the horn, thereby starting to invert the bag over the outside of the horn;

c) continuing to invert the bag over the outside of the horn until the whole bag is inverted and the closed end of the bag covers the open end of the horn;

d) introducing the open end of a product loading chute, containing a product to be loaded into the bag which has been inverted over the horn, a short distance into the open end of the horn, thereby starting to force the bag back into the inside of the horn;

e) introducing the product into the bag using a product discharge means and forcing substantially all of the bag back into the interior of the horn, leaving an amount of the bag adjacent to the bag opening sufficient to allow heat sealing, inverted over the outside of the horn; and f) discharging the now product loaded bag from the opening in the side of said horn;

thereby producing a product loaded bag having a contamination free area of the bag adjacent to the bag opening sufficient for forming a heat seal by a heat sealing means.

2. The method as claimed in claim 1 wherein, said horn and said product chute are made of a rigid to semi-rigid polymeric body selected from the group comprising: polyvinyl chloride tubing, polyethylene tubing, polypropylene tubing, cast acrylic polymer tubing and combinations thereof.

3. The method as claimed in claim 2 wherein, said rigid to semi-rigid polymeric horn body and said product loading chute body are composed of a polypropylene copolymer.

4. The method as claimed in claim 1 wherein, said bag is a heat shrinkable, thermoplastic cook-in bag.

5. The method as claimed in claim 1 whereto, said bag is a heat-shrinkable thermoplastic bag.

6. The method as claimed in claim 1 wherein, said horn and said product chute are made of stainless steel.

7. The method as claimed in claim 1 wherein, said bag is loaded into said horn by manual means.

8. The method as claimed in claim 1 wherein, said bag is loaded into said horn by a mechanical means in an automated process.

9. The method as claimed in claim 1 wherein, said product is introduced into said bag by manual means.

10. The method as claimed in claim 1 wherein, said product is introduced into said bag by a mechanical means in an automated process.

11. The method as claimed in claim 1 wherein, said product is multiple piece whole muscle meat product.

12. The method as claimed in claim 1 wherein, said product is meat emulsion product.

13. The method as claimed in claim 1 wherein, said product is moldable raw meat.

14. The method as claimed in claim 1 wherein, said product is precooked meat product.

15. The method as claimed in claim 1 wherein, said product is non-cooked meat product.

16. The method as claimed in claim 1 wherein, said product is a non-meat product.

17. An apparatus for loading a meat product into a bag comprising: a horn having a closed end, an open end, and a side opening, said side opening adapted to accept a bag having an open end and a closed end and said open end of said horn adapted to allow said bag to be inverted over the outside of said horn; a product loading chute suitable for loading a product to be bagged and having an open end and a closed end adapted to accept a discharge means for moving the loaded product from the product loading chute into the bag positioned in the horn, said product loading chute positioned such that the open end of the product loading chute can be inserted a desired distance into the open end of said horn; and a discharge means located within said product loading chute to force the product out of the product loading chute and into the bag loaded in said horn, said side opening in said horn allowing the bag loaded with product to be discharged from said horn.

18. An apparatus as claimed in claim 17 wherein, said bag and said product are loaded by manual means.

19. An apparatus as claimed in claim 17 wherein, said bag and said product are loaded by mechanical means.

* * * * *